US010711660B1

(12) United States Patent
Zehan

(10) Patent No.: US 10,711,660 B1
(45) Date of Patent: Jul. 14, 2020

(54) CAMSHAFT CONNECTOR OF AN ELECTRIC-HYDRAULIC CAMSHAFT PHASER ASSEMBLY

(71) Applicant: Schaeffler Technologies AG & Co. KG, Herzogenaurach (DE)

(72) Inventor: Dan Zehan, Windsor (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/439,780

(22) Filed: Jun. 13, 2019

(51) Int. Cl.
*F01L 1/344* (2006.01)

(52) U.S. Cl.
CPC ... *F01L 1/3442* (2013.01); *F01L 2001/34469* (2013.01); *F01L 2001/34493* (2013.01); *F01L 2250/02* (2013.01); *F01L 2250/04* (2013.01)

(58) Field of Classification Search
CPC ..... F01L 1/3442; F01L 2001/34486; F01L 2001/34489; F01L 2001/34493; F01L 2001/34496; F01L 1/352; F01L 2001/3521; F01L 1/46; F01L 2013/103; F01L 2820/032
USPC ..... 123/90.15, 90.17
See application file for complete search history.

(56) References Cited

U.S. PATENT DOCUMENTS 6,725,817 B2 4/2004 Methley et al.
7,841,311 B2 11/2010 Hutcheson et al.
8,051,818 B2 11/2011 Myers et al.
9,080,474 B2 7/2015 Wigsten et al.
2010/0089353 A1 4/2010 Myers et al.
2010/0186698 A1 7/2010 Pluta
2018/0274400 A1 9/2018 Berwinkl et al.
2019/0170165 A1* 6/2019 Chung ..... F01L 1/3442
2019/0242277 A1* 8/2019 McCloy ..... F01L 1/352

FOREIGN PATENT DOCUMENTS

DE 102009041755 A1 4/2010

* cited by examiner

*Primary Examiner* — Jorge L Leon, Jr.

(57) ABSTRACT

An electric-hydraulic camshaft phaser assembly, including a hydraulic camshaft phaser and an electric camshaft phaser. The hydraulic camshaft phaser includes: a stator arranged to receive rotational torque and including a plurality of radially inwardly extending protrusions; a rotor arranged to be non-rotatably connected to a first camshaft and including a plurality of radially outwardly extending protrusions circumferentially interleaved with the plurality of radially inwardly extending protrusions; and a plurality of chambers bounded at least in part by the plurality of radially inwardly extending protrusions and the plurality of radially outwardly extending protrusions. The electric camshaft phaser includes: an input non-rotatably connected to the stator; an output gear; and at least one protrusion fixed to the output gear and arranged to be inserted into at least one slot of a second camshaft. The at least one protrusion is arranged to transmit rotational torque from the output gear to the second camshaft.

20 Claims, 13 Drawing Sheets

CAMSHAFT CONNECTOR OF AN ELECTRIC-HYDRAULIC CAMSHAFT PHASER ASSEMBLY

TECHNICAL FIELD

The present disclosure relates to a camshaft connector of an electric camshaft phaser of an electric-hydraulic camshaft phaser assembly.

BACKGROUND

For a known electric-hydraulic camshaft phaser assembly is it known to thread a relatively large bolt into a camshaft to connect an output gear of an electric camshaft phaser to the camshaft.

SUMMARY

According to aspects illustrated herein, there is provided an electric-hydraulic camshaft phaser assembly, including a hydraulic camshaft phaser and an electric camshaft phaser. The hydraulic camshaft phaser includes: a stator arranged to receive rotational torque and including a plurality of radially inwardly extending protrusions; a rotor arranged to be non-rotatably connected to a first camshaft and including a plurality of radially outwardly extending protrusions circumferentially interleaved with the plurality of radially inwardly extending protrusions; and a plurality of chambers bounded at least in part by the plurality of radially inwardly extending protrusions and the plurality of radially outwardly extending protrusions. The electric camshaft phaser includes: an input non-rotatably connected to the stator; an output gear; and at least one protrusion fixed to the output gear and arranged to be inserted into at least one slot of a second camshaft. The at least one protrusion is arranged to transmit rotational torque from the output gear to the second camshaft.

According to aspects illustrated herein, there is provided dual camshaft phaser assembly, including a hydraulic camshaft phaser and an electric camshaft phaser. The hydraulic camshaft phaser includes: a stator arranged to receive rotational torque and including a plurality of radially inwardly extending protrusions; a rotor arranged to be non-rotatably connected to a second camshaft and including a plurality of radially outwardly extending protrusions circumferentially interleaved with the plurality of radially inwardly extending protrusions; and a plurality of chambers bounded at least in part by the plurality of radially inwardly extending protrusions and the plurality of radially outwardly extending protrusions. The electric camshaft phaser includes: an input non-rotatably connected to the stator; an output gear; a phase adjustment element arranged to receive rotational torque from an electric motor and arranged to rotate the output gear with respect to the input; a first non-threaded protrusion fixedly connected to the output gear and extending from the output gear in an axial direction parallel to an axis of rotation of the electric-hydraulic camshaft phaser assembly; and a second non-threaded protrusion fixedly connected to the output gear and extending from the output gear in the axial direction. The first non-threaded protrusion and the second non-threaded protrusion are arranged to be inserted into a first slot and a second slot, respectively of a second camshaft to transmit rotational torque from the output gear to the second camshaft.

According to aspects illustrated herein, there is provided dual camshaft phaser assembly, including a hydraulic camshaft phaser and an electric camshaft phaser. The hydraulic camshaft phaser includes: a stator arranged to receive rotational torque and including a plurality of radially inwardly extending protrusions; a rotor arranged to be non-rotatably connected to a first camshaft and including a plurality of radially outwardly extending protrusions circumferentially interleaved with the plurality of radially inwardly extending protrusions; and a plurality of chambers bounded at least in part by the plurality of radially inwardly extending protrusions and the plurality of radially outwardly extending protrusions. The electric camshaft phaser includes: an input non-rotatably connected to the stator; an output gear; a phase adjustment element arranged to receive rotational torque from an electric motor and arranged to rotate the output gear with respect to the input; a first protrusion integral to the output gear and extending from the output gear in an axial direction parallel to an axis of rotation of the electric-hydraulic camshaft phaser assembly; and a second protrusion integral to the output gear and extending from the output gear in the axial direction. The first protrusion and the second protrusion are arranged to be inserted into a first slot and a second slot, respectively, of a second camshaft to transmit rotational torque from the output gear to the second camshaft.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
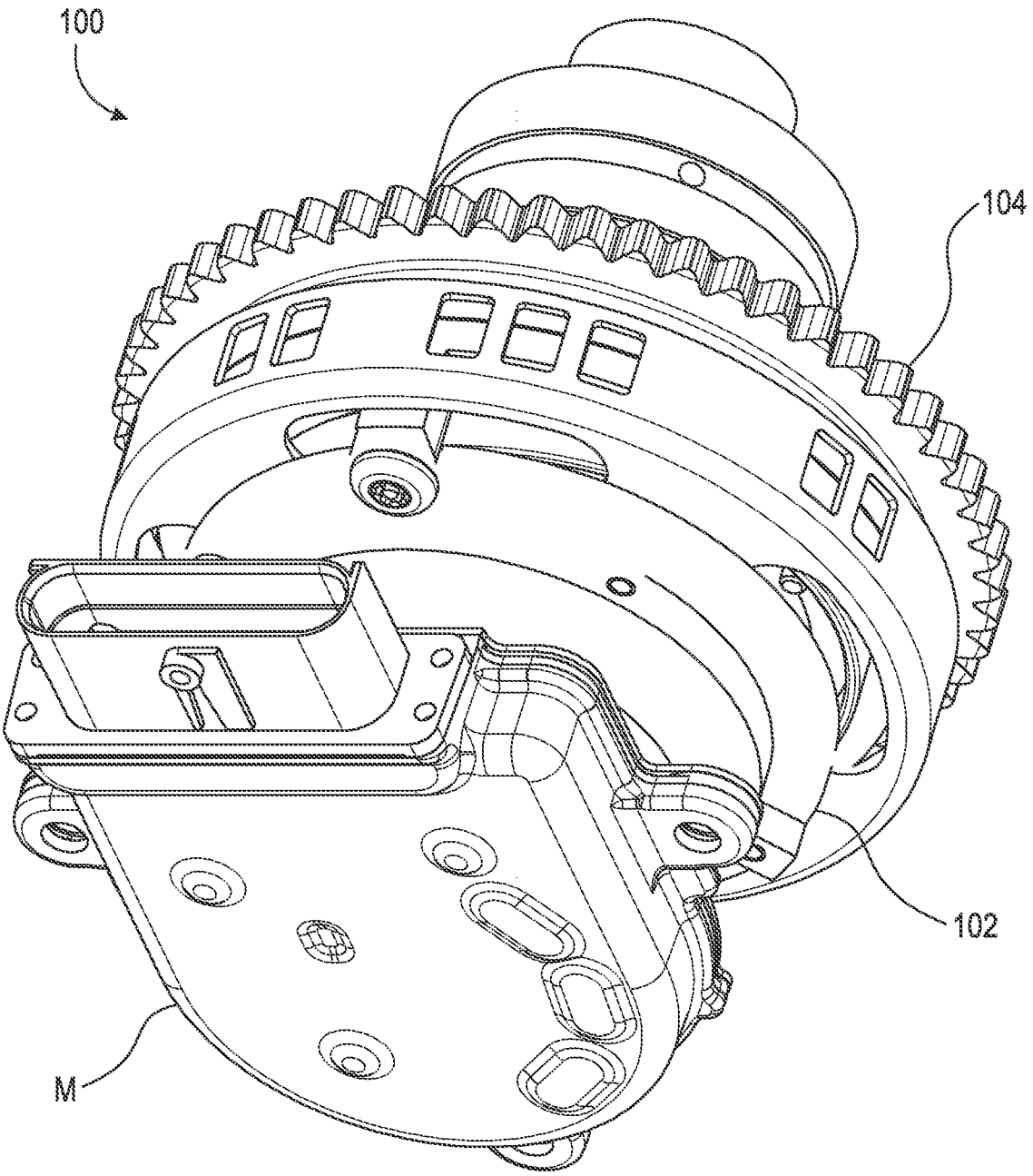
FIG. 1 is an isometric front view of an electric-hydraulic camshaft phaser assembly and motor.

FIG. 1 is an isometric front view of electric-hydraulic camshaft phaser assembly 100 and a motor.

Figure 2:
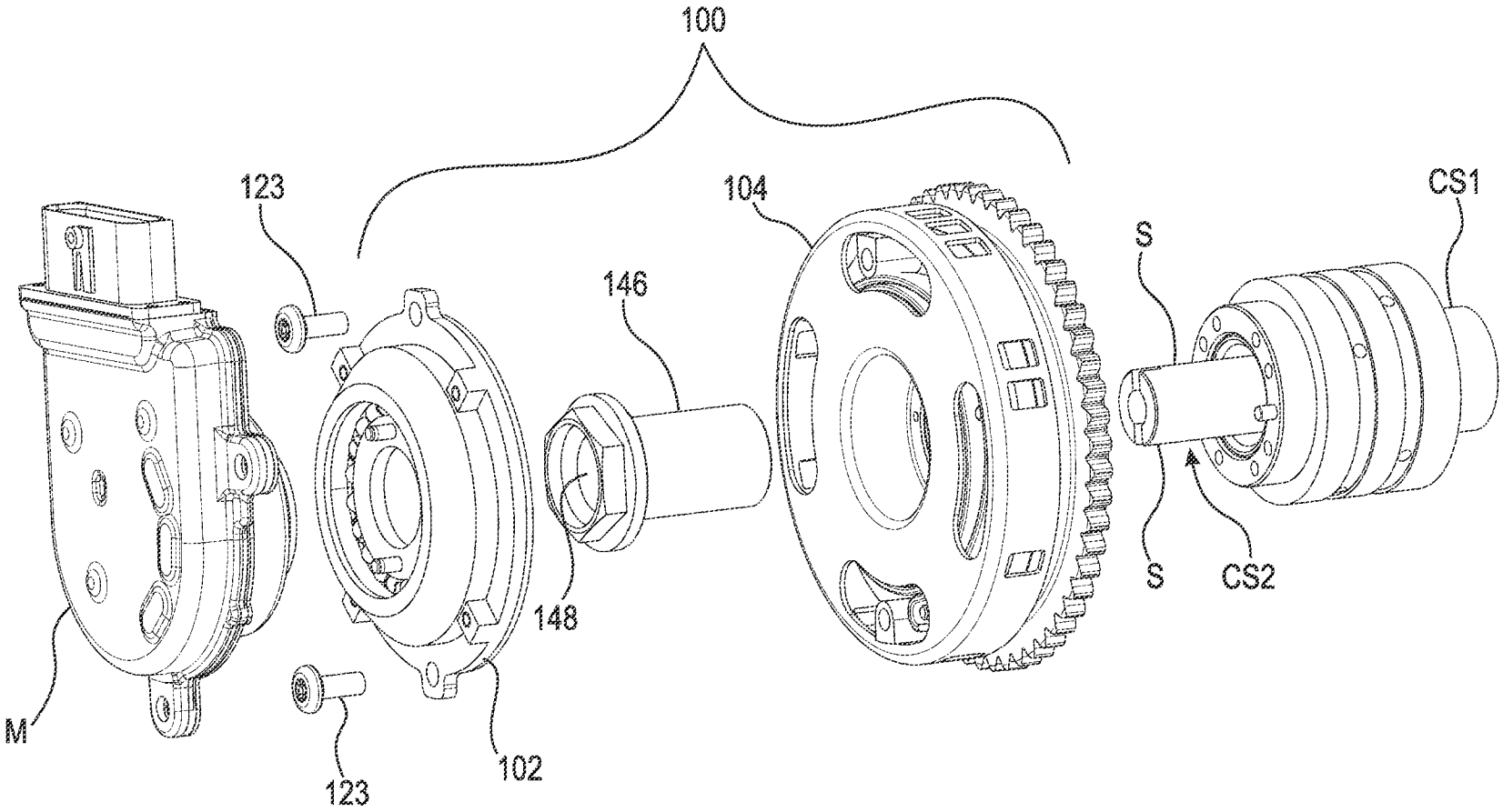
FIG. 2 is an exploded view of the electric-hydraulic camshaft phaser assembly and motor shown in FIG. 1.

FIG. 2 is an exploded view of electric-hydraulic camshaft phaser assembly 100 and the motor shown in FIG. 1.

Figure 3:
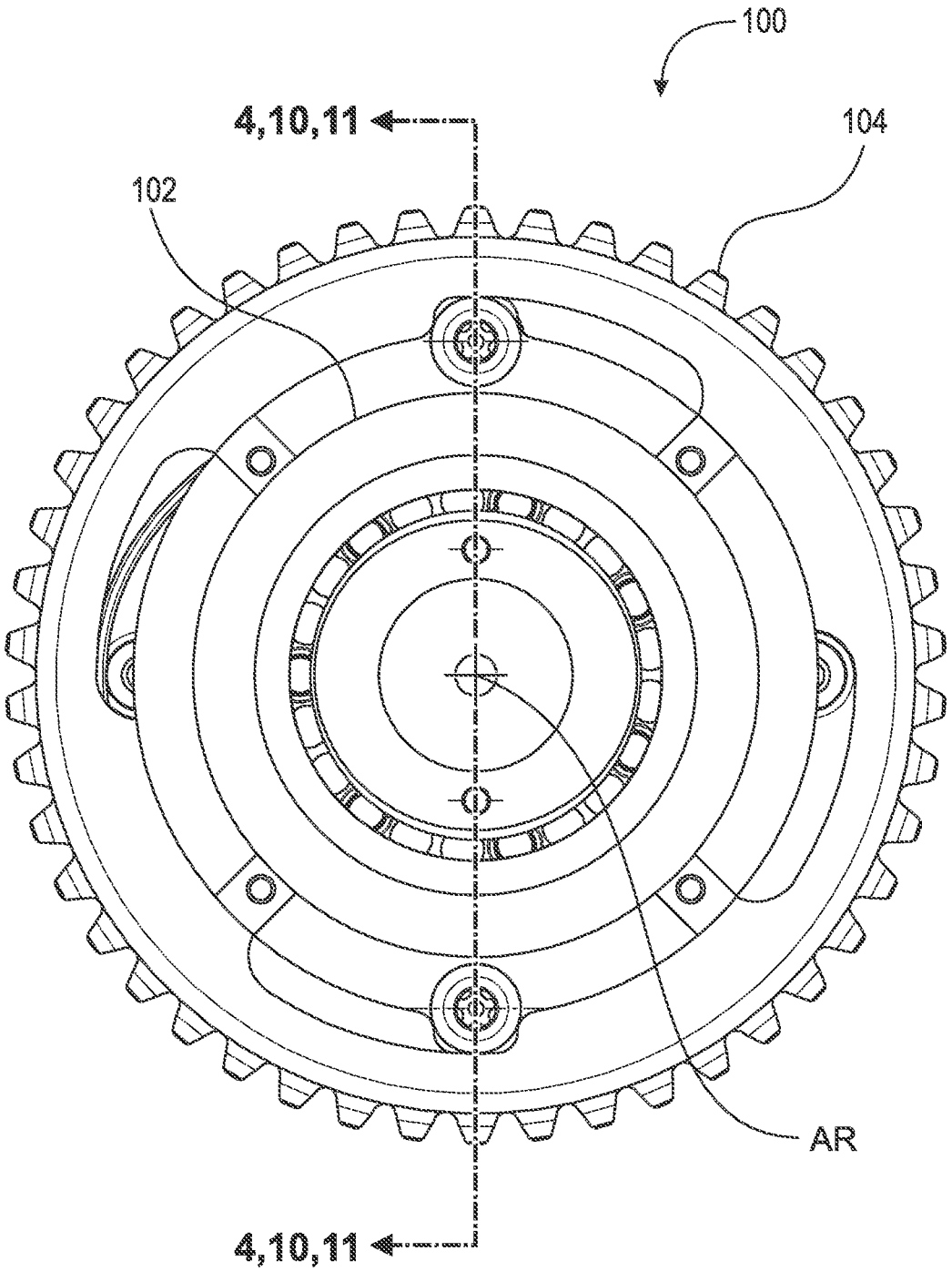
FIG. 3 is a front view of the electric-hydraulic camshaft phaser assembly shown in FIG. 1.

FIG. 3 is a front view of electric-hydraulic camshaft phaser assembly 100 shown in FIG. 1.

Figure 4:
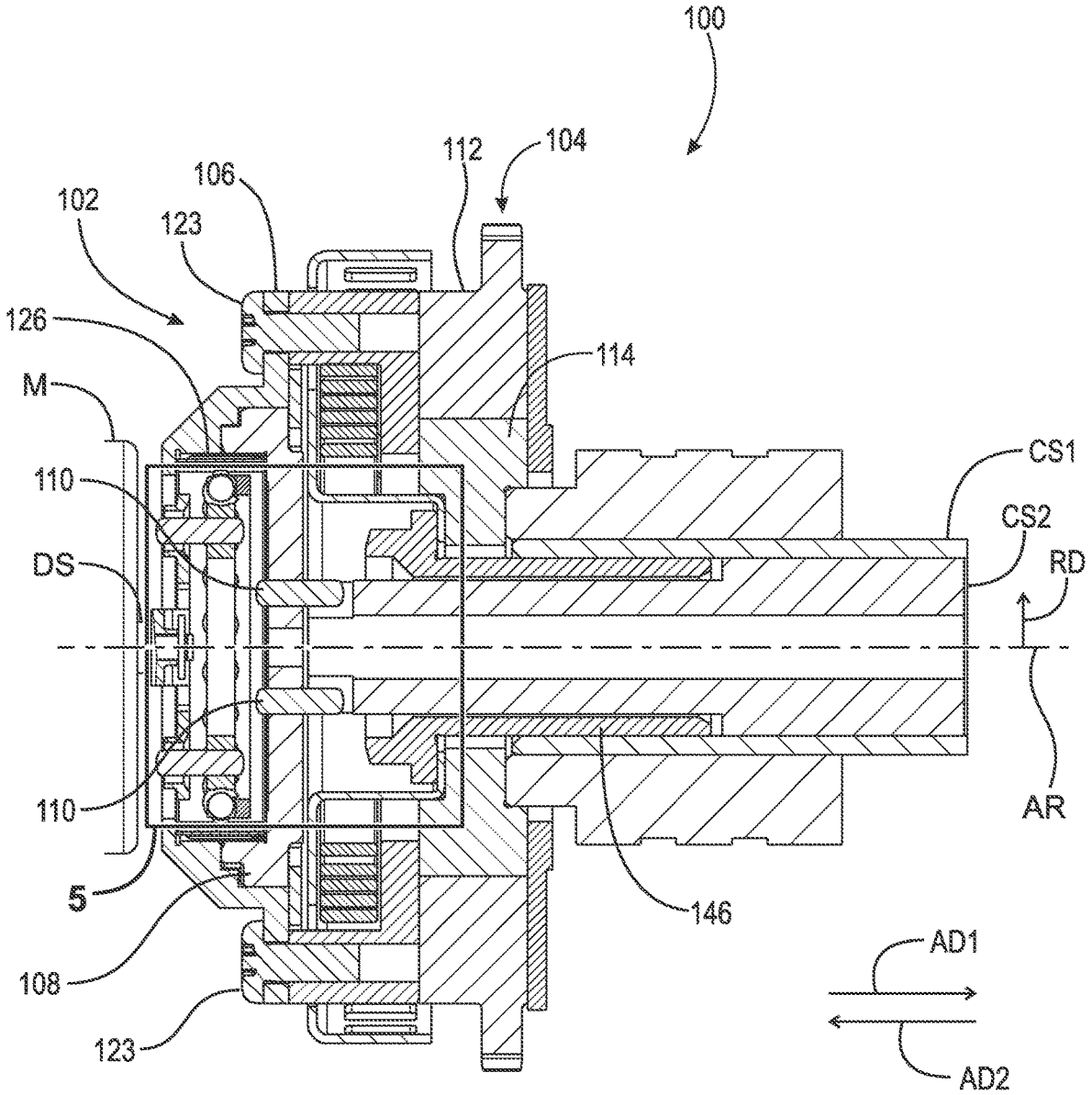
FIG. 4 is a cross-sectional view generally along line 4/10/11-4/10/11 in FIG. 3 of an example of the electric-hydraulic camshaft phaser assembly and motor shown in FIG. 1.

FIG. 4 is a cross-sectional view generally along line 4/10/11-4/10/11 in FIG. 3 of an example of electric-hydraulic camshaft phaser assembly 100 and the motor shown in FIG. 1.

Figure 5:
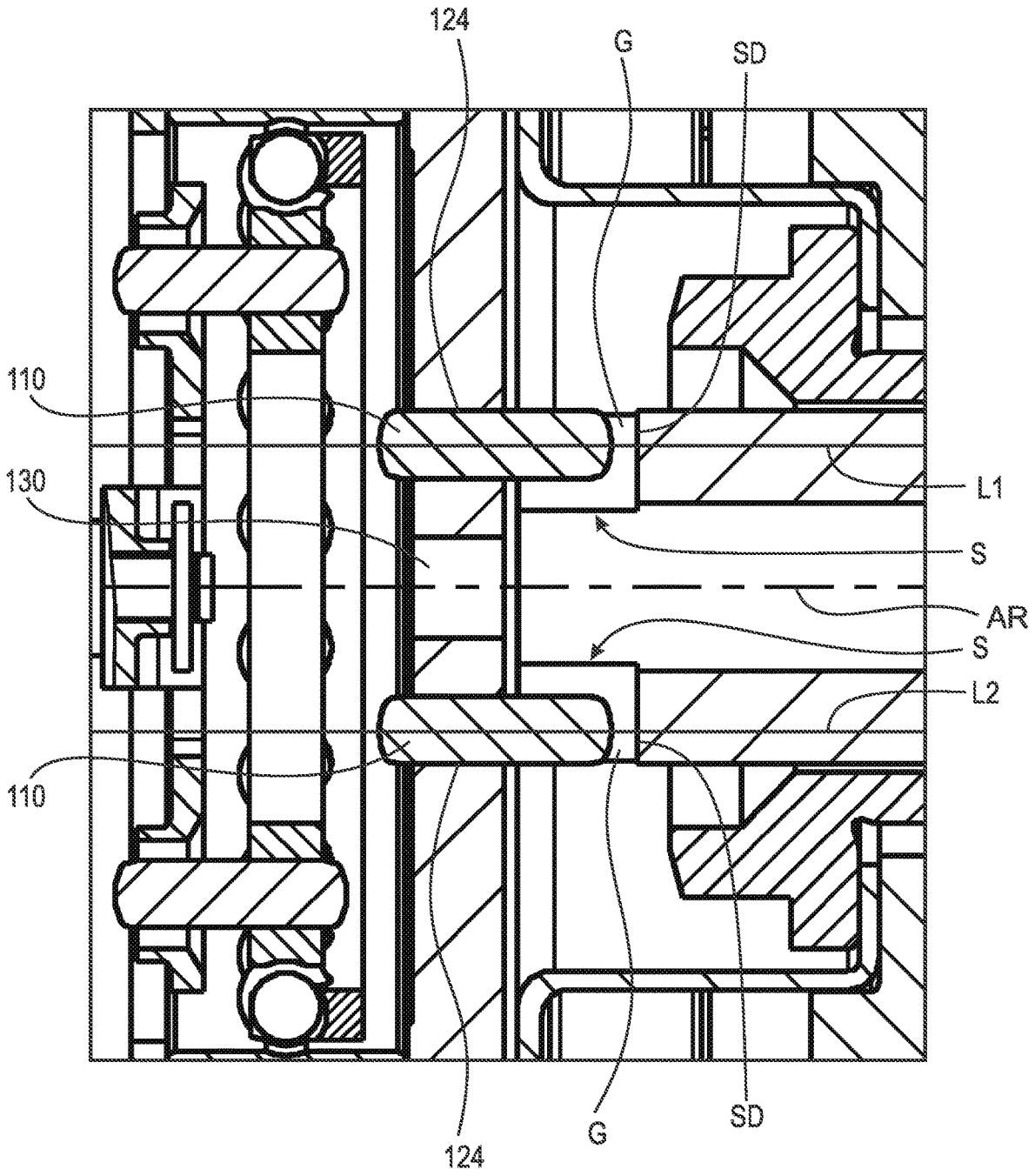
FIG. 5 is a detail of area 5 in FIG. 4.
Figure 6:
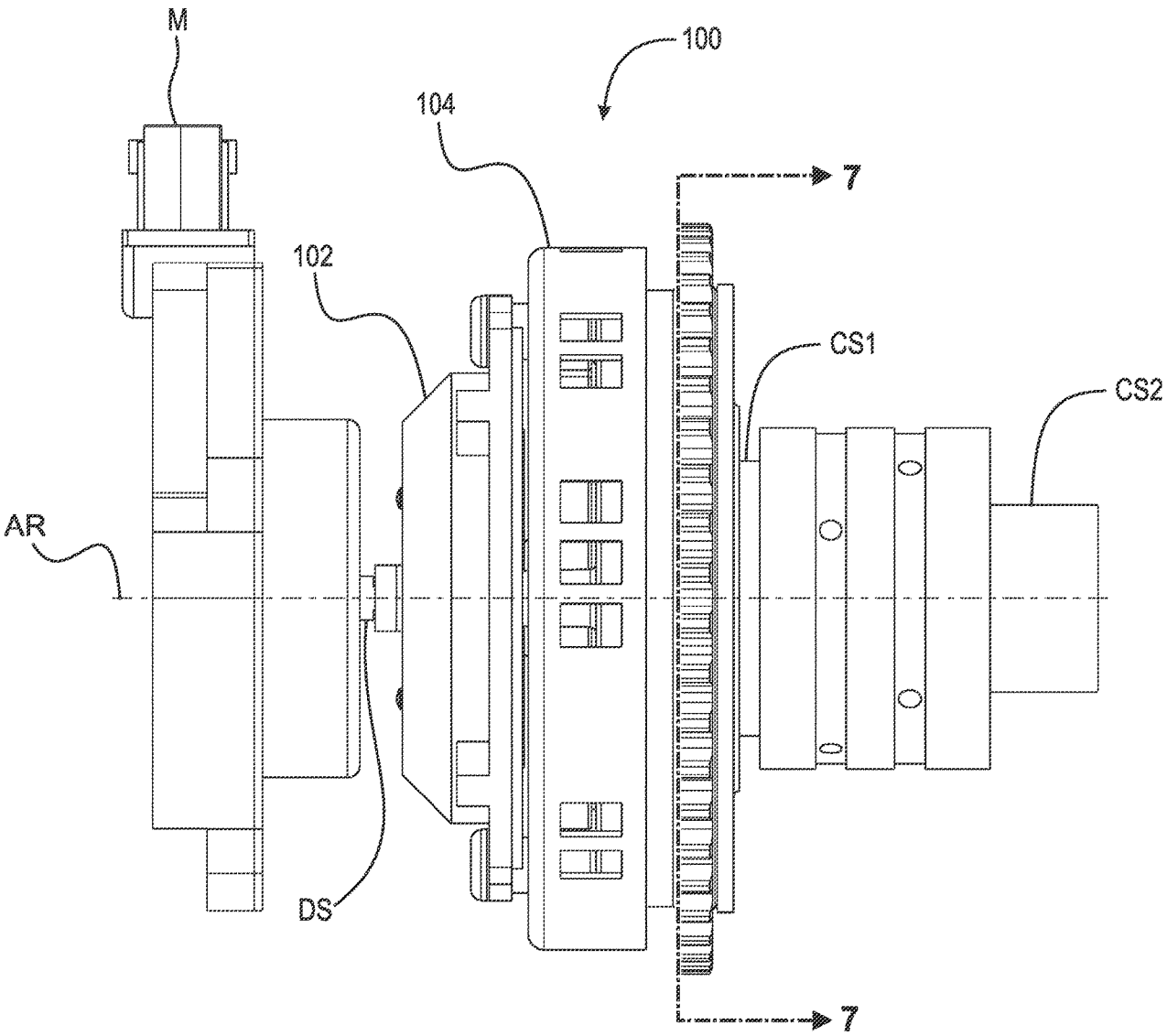
FIG. 6 is a side view of the electric-hydraulic camshaft phaser assembly and motor shown in FIG. 1.

FIG. 5 is a detail of area 5 in FIG. 4;

FIG. 6 is a side view of electric-hydraulic camshaft phaser assembly 100 and the motor shown in FIG. 1.

Figure 7:
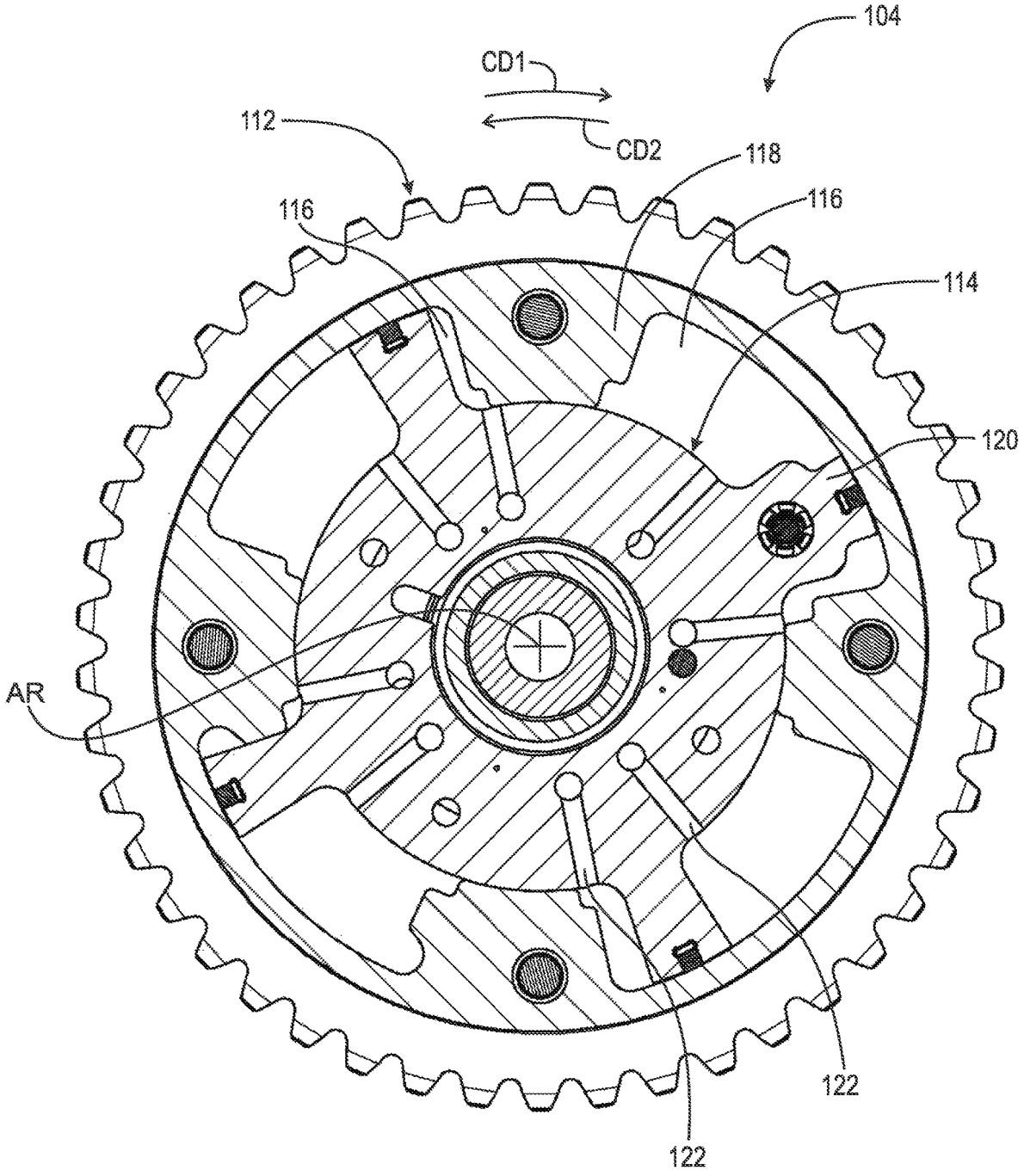
FIG. 7 is cross-sectional view generally line 7-7 in FIG. 6.

FIG. 7 is cross-sectional view generally line 7-7 in FIG. 6. The following should be viewed in light of FIGS. 1 through 7. Electric-hydraulic camshaft phaser assembly 100 includes electric camshaft phaser 102 and hydraulic camshaft phaser 104. Electric camshaft phaser 102 includes input 106 and output gear 108, and at least one protrusion 110. In the example of FIG. 4, assembly 100 includes two protrusions 110. Hydraulic camshaft phaser 104 includes: stator 112 arranged to receive rotational torque, for example from an engine (not shown) of an internal combustion engine; rotor 114; and chambers 116. Stator 112 includes radially inwardly extending protrusions 118. Rotor 114 is arranged to be non-rotatably connected to camshaft CS1 and includes radially outwardly extending protrusions 120 circumferentially interleaved with radially inwardly extending protrusions 118. Chambers 116 are bounded at least in part by radially inwardly extending protrusions 118 and radially outwardly extending protrusions 120. In an example embodiment, protrusions 110 are non-threaded. That is, protrusions 110 are free of threads on exterior surfaces 121 of protrusions 110.

By "non-rotatably connected" components, we mean that components are connected so that whenever one of the components rotates, all the components rotate; and relative rotation between the components is precluded. Radial and/or axial movement of non-rotatably connected components with respect to each other is possible. Components connected by tabs, gears, teeth, or splines are considered as non-rotatably connected despite possible lash inherent in the connection. The input and output elements of a closed clutch are considered non-rotatably connected despite possible slip in the clutch. The input and output parts of a vibration damper, engaged with springs for the vibration damper, are not considered non-rotatably connected due to the compression and unwinding of the springs.

As is known in the art, pressurized fluid is transmitted into and out of chambers 116, via channels 122 in rotor 114 to rotate rotor 114, with respect to stator 112 in opposite circumferential directions CD1 and CD2. Input 106 is non-rotatably connected to stator 112, for example by bolts 123. Protrusions 110 are fixedly secured to output gear 108. In the example of FIG. 4, protrusions 110 are in the shape of cylindrical dowels fixedly inserted into through-bores 124 in output gear 108. It is understood that protrusions 110 are not limited to a particular shape, that is, protrusions 110 can be any shape suitable for engaging camshaft CS2.

In an example embodiment, electric-hydraulic camshaft phaser assembly 100 includes electric motor M. In an example embodiment, electric-hydraulic camshaft phaser assembly 100 is arranged to connect to electric motor M. Drive shaft DS of motor M connects to phase adjustment element 126 of electric camshaft phaser 102. Thus, electric camshaft phaser 102 is axially disposed between motor M and hydraulic camshaft phaser 104. In an example embodiment, element 126 is a harmonic drive. Motor M is arranged to input rotational torque to element 126 to rotate (circumferentially shift) output gear 108 with respect to input 106 about axis AR of assembly 100. Protrusions 110 are arranged to be inserted into slots S of camshaft CS2 to transmit rotational torque (transmitted to input 106 from stator 112) from output gear 108 to camshaft CS2.

In an example embodiment, protrusions 110 are the only component of electric camshaft phaser 102 arranged to directly connect to, or contact, camshaft CS2. In an example embodiment, protrusions 110 include components, or portions, of electric camshaft phaser 102 extending furthest in axial direction AD1 parallel to axis of rotation AR. That is, protrusions 110 are the components of electric camshaft phaser 102 extending furthest in direction AD1. As seen in FIG. 4, axial direction AD1 is from electric camshaft phaser 102 toward hydraulic camshaft phaser 104.

Figure 8:
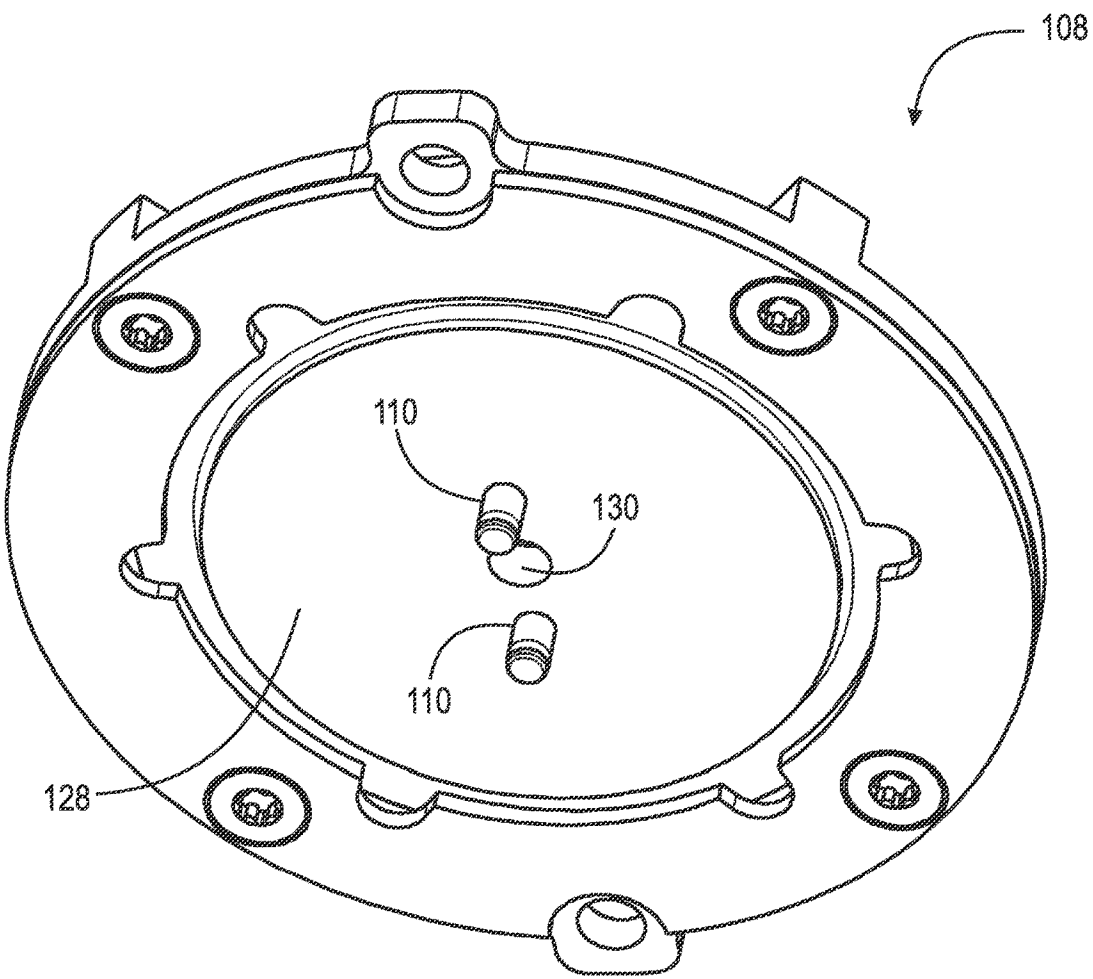
FIG. 8 is a back isometric view of an output gear of the electric-hydraulic camshaft phaser assembly shown in FIG. 4.

FIG. 8 is a back isometric view of output gear 108 of electric-hydraulic camshaft phaser assembly 100 shown in FIG. 4.

Figure 9:
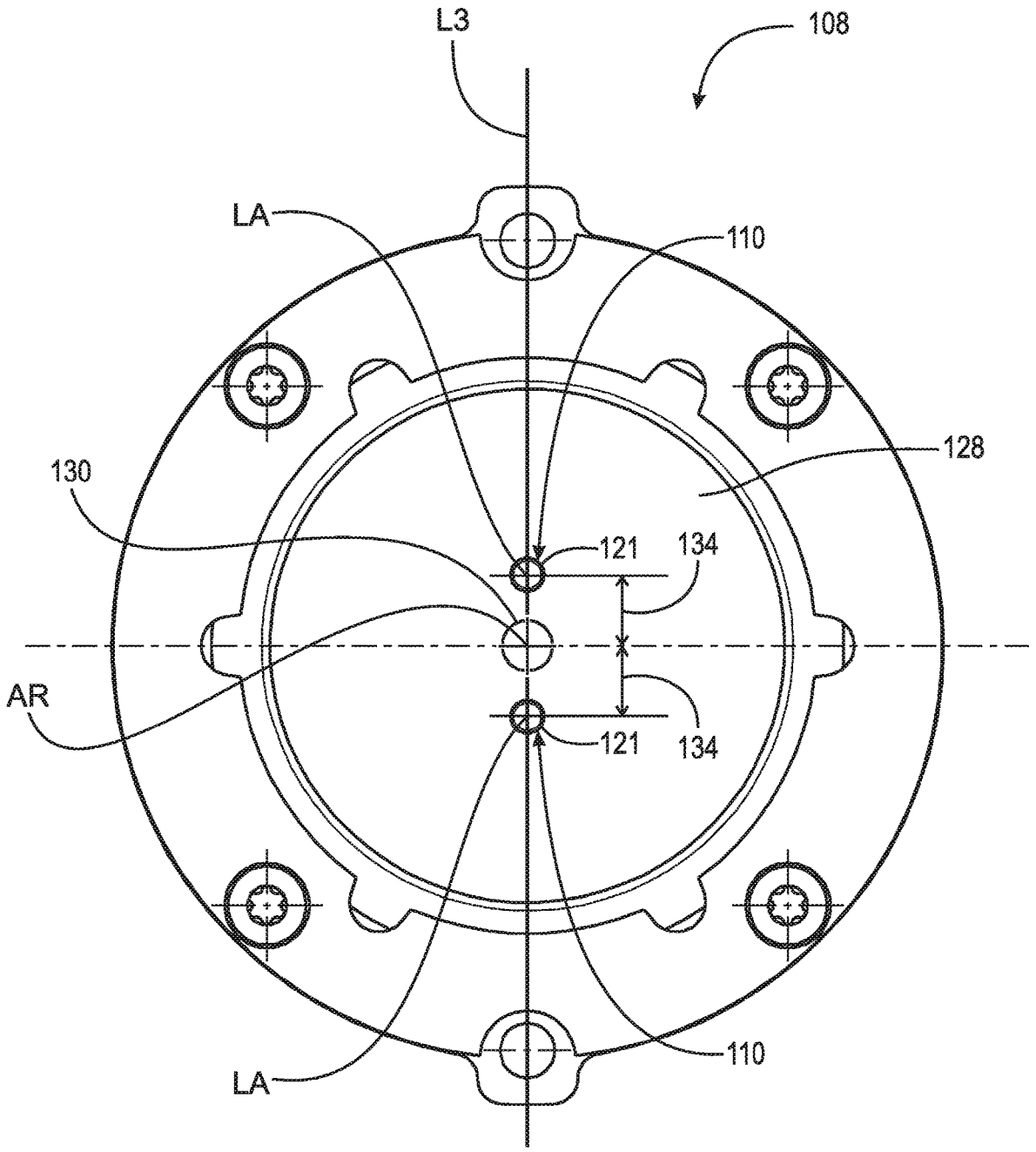
FIG. 9 is a back view of the output gear shown in FIG. 8.

FIG. 9 is a back view of the output gear shown in FIG. 7.

The following should be viewed in light of FIGS. 1 through 9. In an example embodiment: output gear 108 includes surface 128 facing in axial direction AD1; and protrusions 110 extend from surface 128 in axial direction AD1. As seen in the example of FIG. 5, when protrusions 110 are inserted into slots 5, gaps G are present between protrusions 110 and camshaft CS2 in axial direction AD1. For example: line L1, in direction AD1 passes through in sequence: one protrusion 110, a gap G, and a side SD of camshaft CS2 facing in axial direction AD2, opposite direction AD1; and line L2, in direction AD1 passes through in sequence: the other protrusion 110, a gap G, and a side SD of camshaft CS2 facing in axial direction AD2. Gaps G accommodate axial displacement of camshaft CS2 associated with rotation and operation of camshaft CS2, while enabling the transmission of rotational torque from output gear 108 to camshaft CS2.

In an example embodiment, output gear 108 includes through-bore 130, through which axis AR passes. Through-bore 130 provides a path for lubricating oil (not shown) to reach phase adjustment element 126 via camshaft CS2. Protrusions 110 are off-set from through-bore 130 in radial direction RD.

Figure 10:
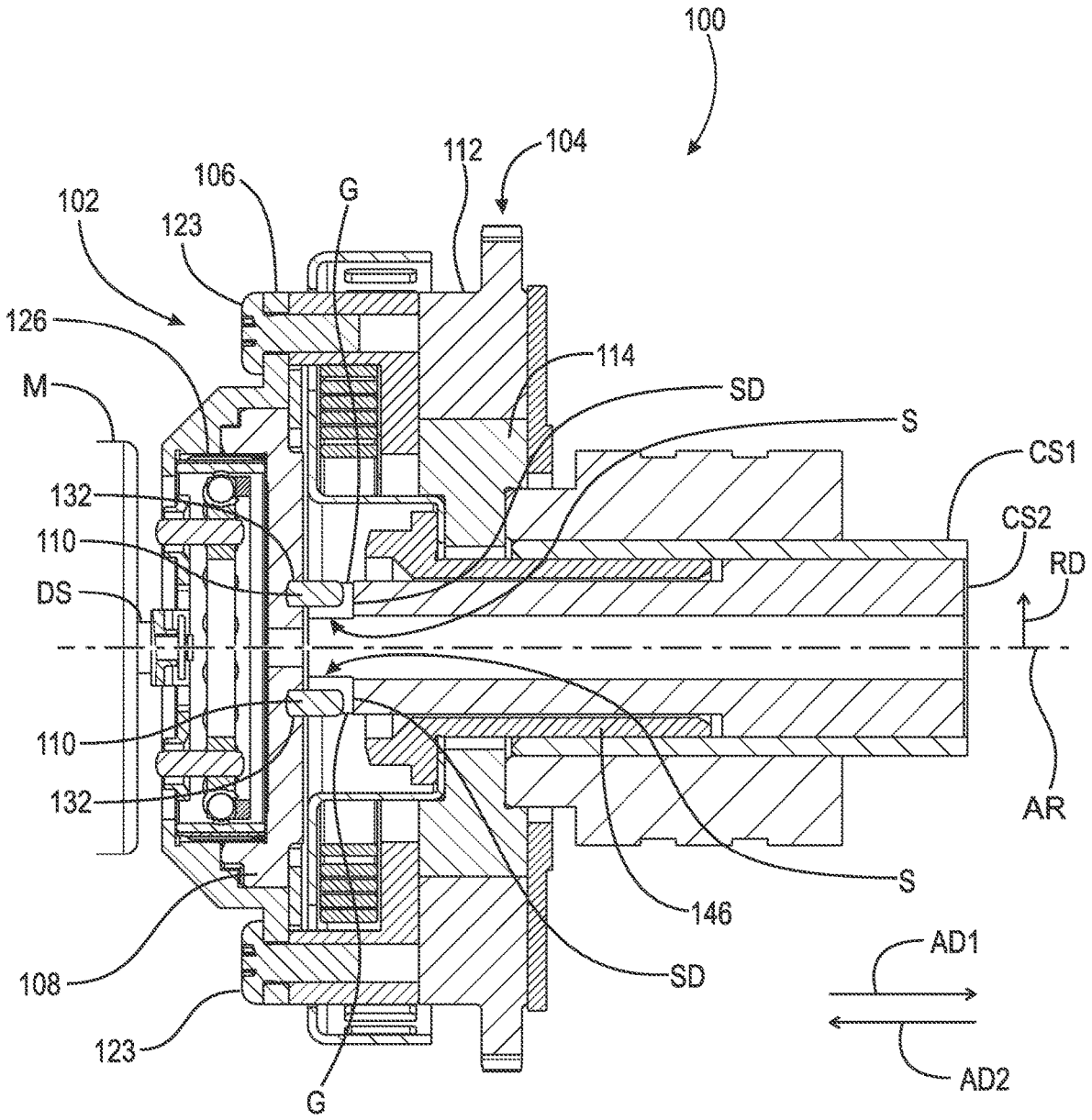
FIG. 10 is a cross-sectional view generally along line 4/10/11-4/10/11 in FIG. 3 of an example of the electric-hydraulic camshaft phaser assembly and motor shown in FIG. 1.

FIG. 10 is a cross-sectional view generally along line 4/10/11-4/10/11 in FIG. 3 of an example of electric-hydraulic camshaft phaser assembly 100 and the motor shown in FIG. 1. The discussion for FIGS. 1 through 9 is applicable to FIG. 10 except as noted. In the example of FIG. 10, output gear 108 includes indentations 134 in place of through-bores 124. Protrusions 110 are fixedly inserted into indentations 134.

As seen in the example of FIG. 9, protrusions 110 are symmetrically disposed about axis AR such that: line 13, orthogonal to axis AR, passes through longitudinal axis LA of each protrusion 110; and each longitudinal axis LA is at an equal distance 132, in direction RD, from axis AR.

Figure 11:
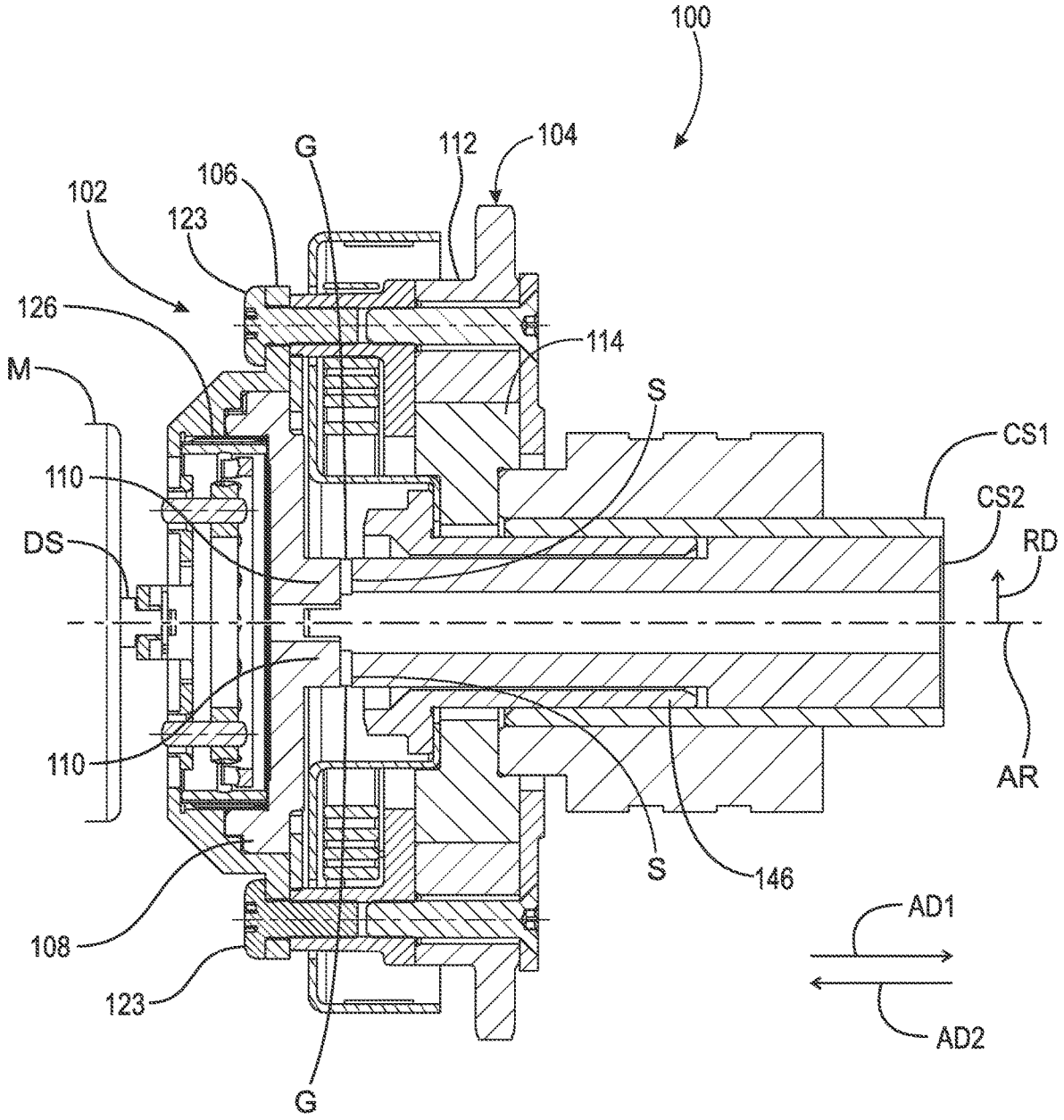
FIG. 11 is a cross-sectional view generally along line 4/10/11-4/10/11 in FIG. 3 of an example of the electric-hydraulic camshaft phaser assembly and motor shown in FIG. 1.

FIG. 11 is a cross-sectional view generally along line 4/10/11-4/10/11 in FIG. 3 of an example of electric-hydraulic camshaft phaser assembly 100 and the motor shown in FIG. 1.

Figure 12:
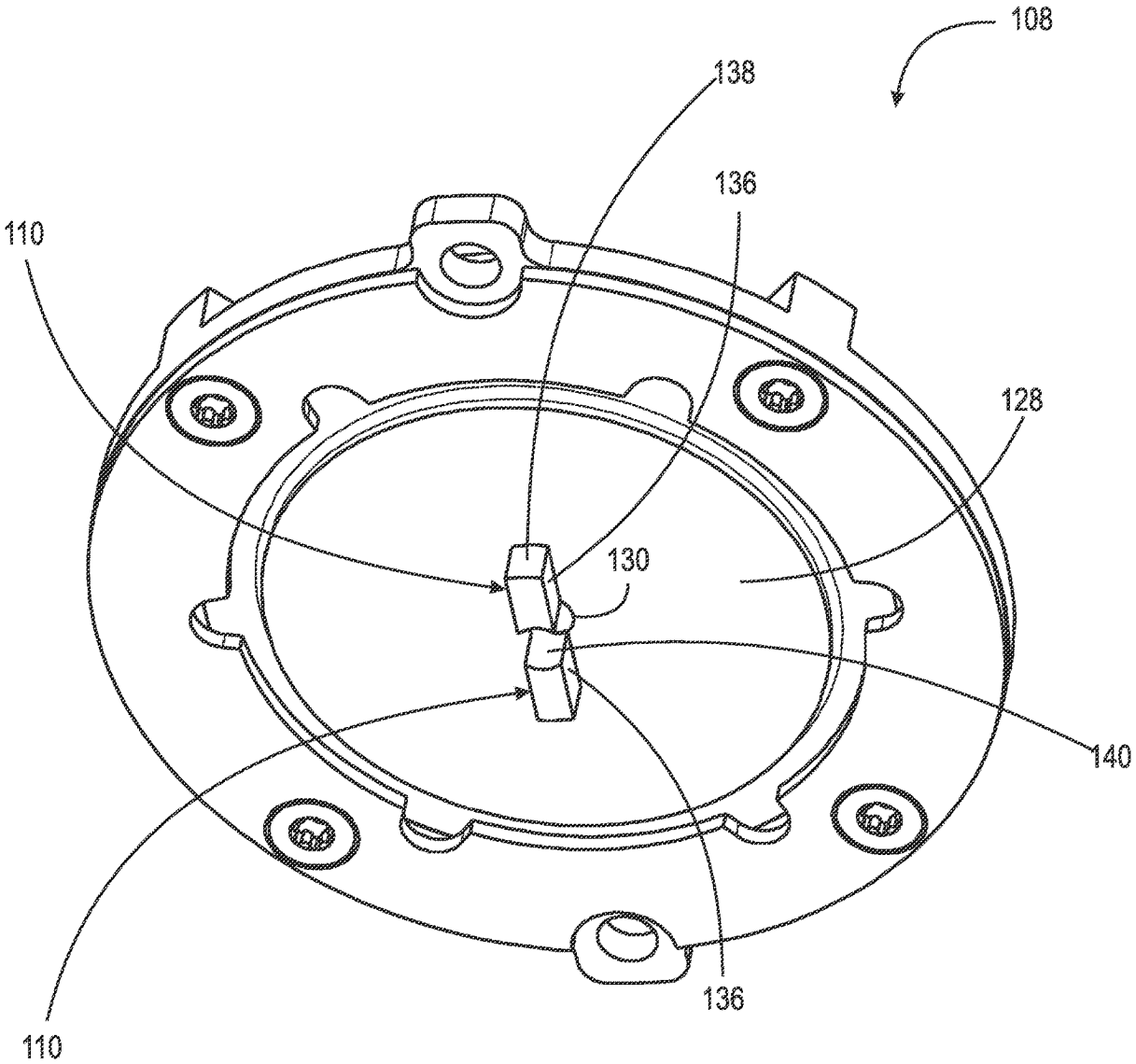
FIG. 12 is a back isometric view of the output gear shown in FIG. 11; and, FIG. 13 is a back view of the output gear shown in FIG. 11.

FIG. 12 is a back isometric view of output gear 108 shown in FIG. 11.

Figure 13:
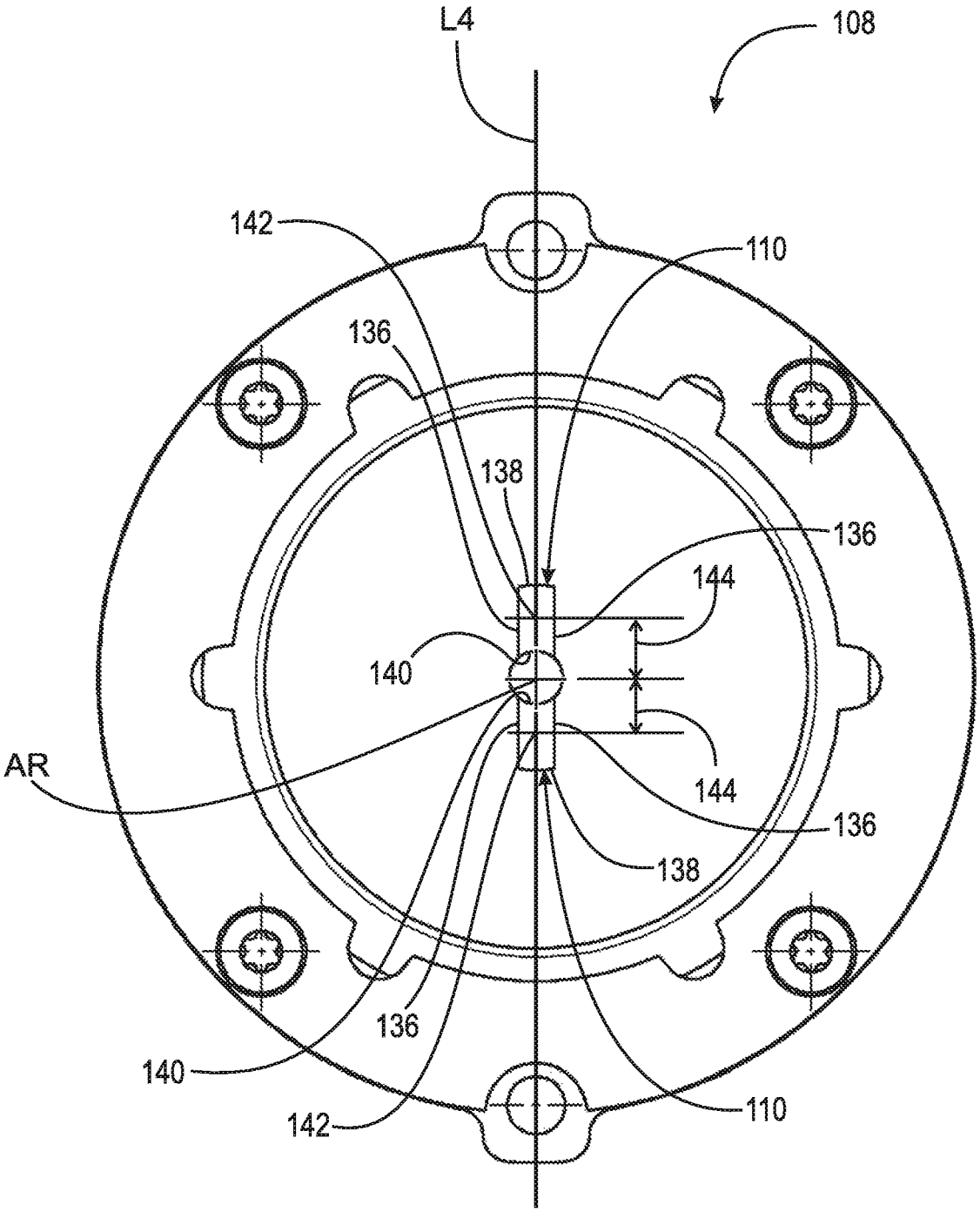

FIG. 13 is a back view of output gear 108 shown in FIG. 11. The discussion for FIGS. 1 through 9 is applicable to FIGS. 11 through 13 except as noted. In the example of FIGS. 11 through 13, output gear 108 and protrusions 110 are monolithic. That is, output gear 108 and protrusions 110 are formed of a same, single piece of material. Stated in another way, protrusions 110 are integral to output gear 108. In an example embodiment, each monolithic protrusion 110 includes: parallel sides 136, side 138 connecting sides 136, and side 140 connecting sides 136 and forming a portion of through-bore 130. In an example embodiment, some or all of sides 136, 138, and 140 are orthogonal to surface 128.

In the example of FIG. 11, when protrusions 110 are inserted into slots S, gaps G are present between protrusions 110 and camshaft CS2 in axial direction AD1. Gaps G accommodate axial displacement of camshaft CS2 associated with rotation and operation of camshaft CS2, while enabling the transmission of rotational torque from output gear 108 to camshaft CS2.

As seen in the example of FIG. 13, protrusions 110 are symmetrically disposed about axis AR such that: line 14, orthogonal to axis AR, passes through center 142 of each protrusion 110; and each center 142 is at an equal distance 144, in direction RD, from axis AR.

In an example embodiment (not shown), protrusions 110 are mechanically fixed to output gear 108, for example by welding or a threaded connection.

In an example embodiment, hydraulic camshaft phaser 104 includes hollow bolt 146 used to non-rotatably connect rotor 114 and camshaft CS1. Bolt 146 threads into camshaft CS1 and includes through-bore 148, through which camshaft CS2 passes.

Protrusions 110 simplify and reduce the cost of providing a connection between electric camshaft phaser 102 and camshaft CS2, replacing the relatively large bolt used for the connection in known electric-hydraulic camshaft phaser assemblies. In particular, protrusions 110, in any of the examples discussed above, and slots S require less material and machining than the connection using the relatively large bolt. For example: assembly 100 is free of a threaded connection between output gear 108 and camshaft CS2; and protrusions 110, whether discrete or integral to gear 108 are much smaller than the bolt. Further, the machining and/or fabricating operations for forming: through-bores 124 or indentations 134; protrusions 110 integral to output gear 108; and slots S are simpler than threading the bolt and camshaft as required for known an electric-hydraulic camshaft phaser assemblies.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

AD1 axial direction
AD2 axial direction
AR axis of rotation
CD1 circumferential direction
CD2 circumferential direction
CS1 camshaft
CS2 camshaft
DS drive shaft
G gap
L1 line
L2 line
L3 line
L4 line
LA longitudinal axis
M electric motor
RD radial direction
S slot
SD side
100 electric-hydraulic camshaft phaser assembly
102 electric camshaft phaser
104 hydraulic camshaft phaser
106 input, electric camshaft phaser
108 output gear, electric camshaft phaser
110 protrusion
112 stator
114 rotor
116 chamber
118 radially inwardly extending protrusion
120 radially outwardly extending protrusion
121 exterior surface, protrusion
122 channel
123 bolt
124 through-bore, output gear
126 phase adjustment element
128 surface, output gear
130 through-bore, output gear
132 indentation, output gear
134 distance
136 side, protrusion
138 side, protrusion
140 side, protrusion
142 center, protrusion
144 distance
146 hollow bolt
148 through-bore, hollow bolt

The invention claimed is:

1. An electric-hydraulic camshaft phaser assembly, comprising:

a hydraulic camshaft phaser including:

a stator arranged to receive rotational torque and including a plurality of radially inwardly extending protrusions;

a rotor arranged to be non-rotatably connected to a first camshaft and including a plurality of radially outwardly extending protrusions circumferentially interleaved with the plurality of radially inwardly extending protrusions; and, a plurality of chambers bounded at least in part by the plurality of radially inwardly extending protrusions and the plurality of radially outwardly extending protrusions; and, an electric camshaft phaser including:

an input non-rotatably connected to the stator;

an output gear; and, at least one protrusion fixed to the output gear and arranged to be inserted into at least one slot of a second camshaft, wherein the at least one protrusion is arranged to transmit rotational torque from the output gear to the second camshaft.

2. The electric-hydraulic camshaft phaser assembly of claim 1, wherein the electric camshaft phaser is arranged to rotate the output gear with respect to the rotor.

3. The electric-hydraulic camshaft phaser assembly of claim 1, wherein the at least one protrusion is an only component of the electric camshaft phaser arranged to contact the second camshaft.

4. The electric-hydraulic camshaft phaser assembly of claim 1, wherein:

the at least one protrusion is a portion of the electric camshaft phaser extending furthest in an axial direction parallel to an axis of rotation of the electric-hydraulic camshaft phaser assembly; and, the axial direction is from the input of the electric camshaft phaser toward the stator of the hydraulic camshaft phaser.

5. The electric-hydraulic camshaft phaser assembly of claim 1, wherein:

the output gear includes a surface facing in an axial direction parallel to an axis of rotation of the electric-hydraulic camshaft phaser assembly; and, the at least one protrusion extends from the surface in the axial direction.

6. The electric-hydraulic camshaft phaser assembly of claim 1, wherein when the at least one protrusion is inserted into the at least one slot:

a gap is present between the at least one protrusion and the second camshaft in a radial direction orthogonal to an axis of rotation of the electric-hydraulic camshaft phaser assembly; or a gap is present between the at least one protrusion and the second camshaft in an axial direction parallel to an axis of rotation of the electric-hydraulic camshaft phaser assembly.

7. The electric-hydraulic camshaft phaser assembly of claim 1, wherein when the at least one protrusion is inserted into the at least one slot, the second camshaft is arranged to be displaced with respect to the at least one protrusion:

in a direction parallel to an axis of rotation of the electric-hydraulic camshaft phaser assembly; or, in a direction orthogonal to the axis of rotation.

8. The electric-hydraulic camshaft phaser assembly of claim 1, wherein when the at least one protrusion is inserted into the at least one slot, a circle, centered on an axis of rotation of the electric-hydraulic camshaft phaser assembly, passes through in sequence, a protrusion included in the at least one protrusion, a gap, and the second camshaft.

9. The electric-hydraulic camshaft phaser assembly of claim 1, wherein:

the at least one protrusion includes a first protrusion and a second protrusion; and, the at least one slot includes:

a first slot arranged to receive the first protrusion; and, a second slot arranged to receive the second protrusion.

10. The electric-hydraulic camshaft phaser assembly of claim 1, wherein the output gear includes at least one indentation, the electric-hydraulic camshaft phaser assembly further comprising:

at least one cylindrical dowel wherein:

the at least one cylindrical dowel includes the at least one protrusion; and, the at least one cylindrical dowel is fixedly inserted into the at least one indentation.

11. The electric-hydraulic camshaft phaser assembly of claim 1, wherein the output gear includes at least one through-bore, the electric-hydraulic camshaft phaser assembly further comprising:

at least one dowel, wherein:

the at least one dowel includes the at least one protrusion; and, the at least one dowel is fixedly inserted into the at least one through-bore.

12. The electric-hydraulic camshaft phaser assembly of claim 1, wherein the at least one protrusion and the output gear are monolithic.

13. The electric-hydraulic camshaft phaser assembly of claim 1, wherein:

the output gear includes a through-bore;

an axis of rotation of the electric-hydraulic camshaft phases assembly passes through the through-bore; and, the at least one protrusion is off-set from the through-bore in a direction orthogonal to the axis of rotation.

14. The electric-hydraulic camshaft phaser assembly of claim 1, further comprising an electric motor including a drive shaft connected to the electric camshaft phaser and wherein the electric camshaft phaser is axially disposed between the electric motor and the hydraulic camshaft phaser; or, wherein the electric camshaft phaser is arranged to connect to a drive shaft of an electric motor, and the electric camshaft phaser is axially disposed between the electric motor and the hydraulic camshaft phaser.

15. The electric-hydraulic camshaft phaser assembly of claim 14, wherein:

the electric camshaft phaser includes a harmonic drive; and, the harmonic drive is:

connected to the drive shaft, the input, and the output gear; and, arranged to circumferentially shift the output gear with respect to the input.

16. The electric-hydraulic camshaft phaser assembly of claim 1, wherein the at least one protrusion is not threaded.

17. An electric-hydraulic camshaft phaser assembly, comprising:

a hydraulic camshaft phaser including:

a stator arranged to receive rotational torque and including a plurality of radially inwardly extending protrusions;

a rotor arranged to be non-rotatably connected to a first camshaft and including a plurality of radially outwardly extending protrusions circumferentially interleaved with the plurality of radially inwardly extending protrusions; and, a plurality of chambers bounded at least in part by the plurality of radially inwardly extending protrusions and the plurality of radially outwardly extending protrusions; and, an electric camshaft phaser including:

an input non-rotatably connected to the stator;

an output gear;

a phase adjustment element arranged to receive rotational torque from an electric motor and arranged to rotate the output gear with respect to the input;

a first non-threaded protrusion fixedly inserted into a first through-bore or a first indentation of the output gear, and extending from the output gear in a first axial direction parallel to an axis of rotation of the electric-hydraulic camshaft phaser assembly; and, a second non-threaded protrusion fixedly inserted into a second through-bore or a second indentation of the output gear, and extending from the output gear in the first axial direction, wherein the first non-threaded protrusion and the second non-threaded protrusion are arranged to be inserted into a first slot and a second slot, respectively, of a second camshaft so as to transmit rotational torque from the output gear to the second camshaft.

18. The electric-hydraulic camshaft phaser assembly of claim 17, wherein:

the first and second non-threaded protrusions are an only component of the electric camshaft phaser arranged to contact the second camshaft; or, the first and second non-threaded protrusions include portions of the electric camshaft phaser extending furthest in the first axial direction; or, when the first non-threaded protrusion and the second non-threaded protrusion are inserted into the first slot and the second slot, respectively:

a line, in the first axial direction, passes through in sequence, the first non-threaded protrusion, a first gap, and a surface of the second camshaft facing in a second axial direction, opposite the first axial direction; and, a circle, centered on the axis of rotation, passes through in sequence, the first non-threaded protrusion, a second gap, and the second camshaft.

19. An electric-hydraulic camshaft phaser assembly, comprising:

a hydraulic camshaft phaser including:

a stator arranged to receive rotational torque and including a plurality of radially inwardly extending protrusions;

a rotor arranged to be non-rotatably connected to a first camshaft and including a plurality of radially outwardly extending protrusions circumferentially interleaved with the plurality of radially inwardly extending protrusions; and, a plurality of chambers bounded at least in part by the plurality of radially inwardly extending protrusions and the plurality of radially outwardly extending protrusions; and, an electric camshaft phaser including:

an input non-rotatably connected to the stator;

an output gear;

a phase adjustment element arranged to receive rotational torque from an electric motor and arranged to rotate the output gear with respect to the input;

a first protrusion integral to the output gear and extending from the output gear in an axial direction parallel to an axis of rotation of the electric-hydraulic camshaft phaser assembly; and, a second protrusion integral to the output gear and extending from the output gear in the axial direction, wherein the first protrusion and the second protrusion are arranged to be inserted into a first slot and a second slot, respectively, of a second camshaft so as to transmit rotational torque from the output gear to the camshaft.

20. The electric-hydraulic camshaft phaser assembly of claim 19, wherein:

the first and second protrusions are an only component of the electric camshaft phaser arranged to contact the second camshaft; or, the first and second protrusions include portions of the electric camshaft phaser extending furthest in the axial direction; or, when the first protrusion and the second protrusion are inserted into the first slot and the second slot, respectively, a circle, centered on the axis of rotation, passes through in sequence, the first protrusion, a gap and the second camshaft.

* * * * *